US006093919A

United States Patent [19]

Seo et al.

[11] Patent Number: 6,093,919

[45] Date of Patent: Jul. 25, 2000

[54] COOLING DEVICE FOR HALOGEN LAMPS IN MICROWAVE OVENS

[75] Inventors: Dong-Wan Seo; Sang-Ki Lee, both of Changwon Gyeongnam, Rep. of Korea

[73] Assignee: LG Electronics Inc., Seoul, Rep. of Korea

[21] Appl. No.: 09/362,896

[22] Filed: Jul. 29, 1999

[30] Foreign Application Priority Data

Jul. 29, 1998 [KR] Rep. of Korea ..... 98-30640

[51] Int. Cl.[7] ..... H05B 6/80

[52] U.S. Cl. ..... 219/685; 219/757; 392/416; 392/422; 126/21 A

[58] Field of Search ..... 219/685, 680, 219/757, 738; 126/21 A; 392/407, 408, 410, 416, 422

[56] References Cited

U.S. PATENT DOCUMENTS 4,493,960 1/1985 Mittelsteadt et al. ..... 219/685

FOREIGN PATENT DOCUMENTS 54-21638 2/1979 Japan ..... 219/685
2-247420 10/1990 Japan ..... 219/685
3-5628 1/1991 Japan ..... 219/685
5-52352 3/1993 Japan ..... 219/757

*Primary Examiner*—Philip H. Leung
*Attorney, Agent, or Firm*—Fleshner & Kim, LLP

[57] ABSTRACT

A cooling device for halogen lamps in microwave ovens is disclosed. In a microwave oven, the halogen lamp is installed on the top wall of a cavity. The lamp is operated by electric power applied thereto through a sealing part provided at each end thereof. The lamp thus radiates heating light waves, having a predetermined wavelength, into the cavity. A light reflection plate surrounds and holds the halogen lamp while forming a lamp chamber on the top wall of the cavity and allows the light waves to be guided from the lamp into the cavity, with the sealing parts of the lamp being positioned outside the light reflection plate. A cooling device generates a cooling air current and guides the cooling air current to the sealing parts positioned outside the light reflection plate.

8 Claims, 5 Drawing Sheets

COOLING DEVICE FOR HALOGEN LAMPS IN MICROWAVE OVENS

BACKGROUND OF THE INVENTION

1. Field of the Invention

The present invention relates, in general, to a cooling device for halogen lamps in microwave ovens and, more particularly, to a cooling device designed to expose the sealing parts of a halogen lamp to a cooling air current.

2. Description of the Prior Art

As well known to those skilled in the art, a variety of cooking devices have been proposed and used. Of the cooking devices, the primary one is cooking ware, which is designed to have a shape suitable for containing food therein and is laid on a heater so as to be directly heated by the heater while cooking.

In addition, several types of electric cooking devices, designed to directly or indirectly utilize electric power while cooking, have been proposed and used. An example of conventional electric cooking devices is a microwave oven using a magnetron as a heat source. In such a microwave oven, the magnetron is electrically operated to generate microwaves and applies the microwaves to food in a cavity, thus allowing the microwaves to cause an active molecular motion in the food. Such an active molecular motion in the food generates molecular kinetic energy, thus heating and cooking the food. Such microwave ovens are advantageous in that they have a simple construction and are convenient to a user while cooking, and easily and simply heat food in the cavity. The microwave ovens are thus somewhat preferably used for some cooking applications, such as a thawing operation for frozen food or a heating operation for milk requiring to be heated to a desired temperature.

However, such microwave ovens also have the following problems. That is, the ovens have a defect in their heating style in addition to limited output power of the magnetron, and so it is almost impossible to freely or preferably use them for a variety of cooking applications, without limitation. In a detailed description, the conventional microwave ovens only utilize a magnetron as a heat source, thus undesirably having a single heating style. In addition, the output power of the magnetron, installed in such ovens, is limited to a predetermined level. Therefore, the conventional microwave ovens fail to provide a quick and highly effective cooking operation. During a cooking operation utilizing such a microwave oven, food in a cavity is heated at its internal and external portions at the same time, and this may be an advantage of the oven in some cases. However, such a heating style may result in a disadvantage while cooking some food. For example, the cooking style of the conventional microwave ovens is not suitable for cooking pizza for reasons that will be described in more detail later herein. Another disadvantage, experienced in the conventional microwave ovens, resides in that the ovens exceedingly remove moisture from food.

In an effort to overcome the above-mentioned problems, several types of microwave ovens, having another heat source in addition to a magnetron, have been proposed and used. For example, a microwave oven, having a convection heater in addition to a magnetron in a casing and originally designed to be used for a variety of cooking applications, has been proposed. However, such a convection heater only acts as a single heat source, thus failing to allow the microwave oven to have a variety of operational functions.

In a brief description, the conventional microwave ovens are problematic in that they have a single heating style utilizing microwaves, limited output power of a magnetron, and cause the evaporation of an exceeding amount of moisture from food. The microwave ovens, having another heater in addition to a magnetron, fail to completely overcome the problems experienced in the conventional microwave ovens.

In order to solve the problems of the conventional microwave ovens, another type of microwave oven, utilizing a light wave, has been proposed. In this microwave oven, a lamp, wherein at least 90% of the radiation energy has a wavelength of not longer than 1 $\mu$m, is used as the additional heat source. In said microwave oven, both visible rays and infrared rays from the lamp are appropriately used, and it is possible to preferably heat the exterior and interior of food while making the most of characteristics of the food. An example of such a lamp is a halogen lamp.

Due to a difference in wavelengths between the infrared rays and visible rays emanating from a halogen lamp, the heating styles for the exterior and interior of food are different from each other. While cooking pizza utilizing a halogen lamp, it is possible to appropriately heat the pizza in a way such that the exterior of the pizza is heated to become crisp and the interior is heated to be soft while maintaining appropriate moisture.

FIG. 1 is a conventional microwave oven utilizing a halogen lamp as an additional heat source. As shown in the drawing, the microwave oven comprises a halogen lamp 12 installed on the top wall 10 of a cavity 2. The microwave oven uses the light waves, radiated from the lamp 12, for heating food in the same manner as that described above, with the characteristics of the light waves remaining the same as that described above.

A light reflection plate 14 is installed at a position above the halogen lamp 12, thus reflecting any light waves, emanating upwardly from the lamp 12, back downwardly into the cavity 2. A plurality of light transmitting holes 16 are formed on the top wall of the cavity 2, with the halogen lamp 12 being held on the top wall. The structure for holding the halogen lamp 12 within the reflection plate 14 is shown in FIGS. 2 and 3. As shown in the drawings, the reflection plate 14, surrounding the halogen lamp 12, is closed by a support member 18 at each end thereof. The support member 18 is also used for supporting each end of the lamp 12. The halogen lamp 12 has a sealing part 12*a* at each end thereof. At the sealing part 12*a*, an external lead wire 17 is connected to an internal filament 12*b* of the lamp 12. An electric insulator part 12*c*, made of a ceramic material, is provided on each end of the lamp 12 at a position outside the sealing part 12*a*.

Since the halogen lamp 12 generates a great quantity of light waves during an operation of the microwave oven, the lamp 12 is heated to a high temperature during an operation of the microwave oven. In addition, when the interior equipment of the microwave oven is overheated, there may occur safety hazards, such as fire, in the microwave oven. Therefore, it is necessary to cool the interior equipment, such as the halogen lamp 12, to an acceptable temperature of not higher than a reference point. For example, it is necessary to cool the halogen lamp 12 to a temperature of not higher than 800° C. and to cool the sealing part 12*a* to a temperature of not higher than 300° C. However, the sealing part 12*a* of the halogen lamp 12 is apt to be undesirably overheated during an operation of the microwave oven.

The conventional structure for holding the halogen lamp 12 relative to the light reflection plate 14 is designed as follows.

As shown in FIGS. 2 and 3, the two electric insulator parts 12*c* of the halogen lamp 12 are held by the two support members 18. This is caused by the fact that it is easier and more effective to hold the lamp 12 on the members 18 at the insulator parts 12*c*. Such a holding structure renders the two sealing parts 12*a* to be positioned within the light reflection plate 14. In FIG. 3, the reference numeral 22 denotes a mesh member used for guiding the heating light from the lamp 12 into the cavity 2. The reference numeral 24 denotes a lamp protection filter used for protecting the lamp 12 from the steam and oil smoke laden with impurities rising from food during a cooking operation.

A cooling fan unit (not shown) is installed within the microwave oven so as to cool the halogen lamp 12. The above cooling fan unit generates a cooling air current that is mainly used for cooling the lamp 12. As well known to those skilled in the art, the parts of the halogen lamp 12, which most require cooling, are the sealing parts 12*a*. However, since the sealing parts 12*a* are positioned within the reflection plate 14 and are covered with the support members 18 in the conventional structure, the sealing parts 12*a* fail to be effectively cooled to a desired temperature.

When the halogen lamp 12 is turned on and radiates the heating light, the interior of the reflection plate 14 is further heated to a higher temperature. In this regard, it is a very important factor to effectively cool the sealing parts 12*a* to a desired temperature. When the sealing parts 12*a* fail to be effectively cooled, the expected life span of the lamp 12 is undesirably shortened. This results in a reduction in the operational reliability and market competitiveness of the microwave ovens.

SUMMARY OF THE INVENTION

Accordingly, the present invention has been made keeping in mind the above problems occurring in the prior art, and an object of the present invention is to provide a cooling device for halogen lamps in microwave ovens, which is designed to effectively cool the sealing parts of a halogen lamp.

In order to accomplish the above object, the present invention provides a cooling device for light radiating lamps in microwave ovens, comprising: a light radiating lamp installed on a top wall of a cavity of a microwave oven, the lamp being operated by electric power applied thereto through a sealing part provided at each end thereof, the lamp thus radiating heating light waves, having a predetermined wavelength, into the cavity; a light reflection means surrounding and holding the light radiating lamp while forming a lamp chamber on the top wall of the cavity and allowing the light waves to be guided from the lamp into the cavity, with the sealing part of the lamp being positioned outside the light reflection means; and cooling means for generating a cooling air current and guiding the cooling air current to the sealing part positioned outside the light reflection means.

In the preferred embodiment of this invention, the light reflection means comprises: a light reflection plate used for reflecting the light waves emanating from the lamp; and a side member mounted to each end of the light reflection plate and used for covering each end of the plate and holding each end of the lamp, with the sealing part, provided at each end of the lamp, being positioned outside the side member.

Each end of the lamp, including the sealing part and being positioned outside the light reflection means, is held by a support means. In the preferred embodiment of this invention, the support means comprises an elastic clamp having a fitting mouth at its top end, thus removably clamping each end of the lamp.

In the above cooling device, the clamp holds an electric insulator part of the lamp, the insulator part being provided at each end of the lamp at a position outside the sealing part. In addition, the side member, provided at each end of the light reflection plate, is provided with a plurality of air passing holes for introducing the cooling air current into the interior of the light reflection plate.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
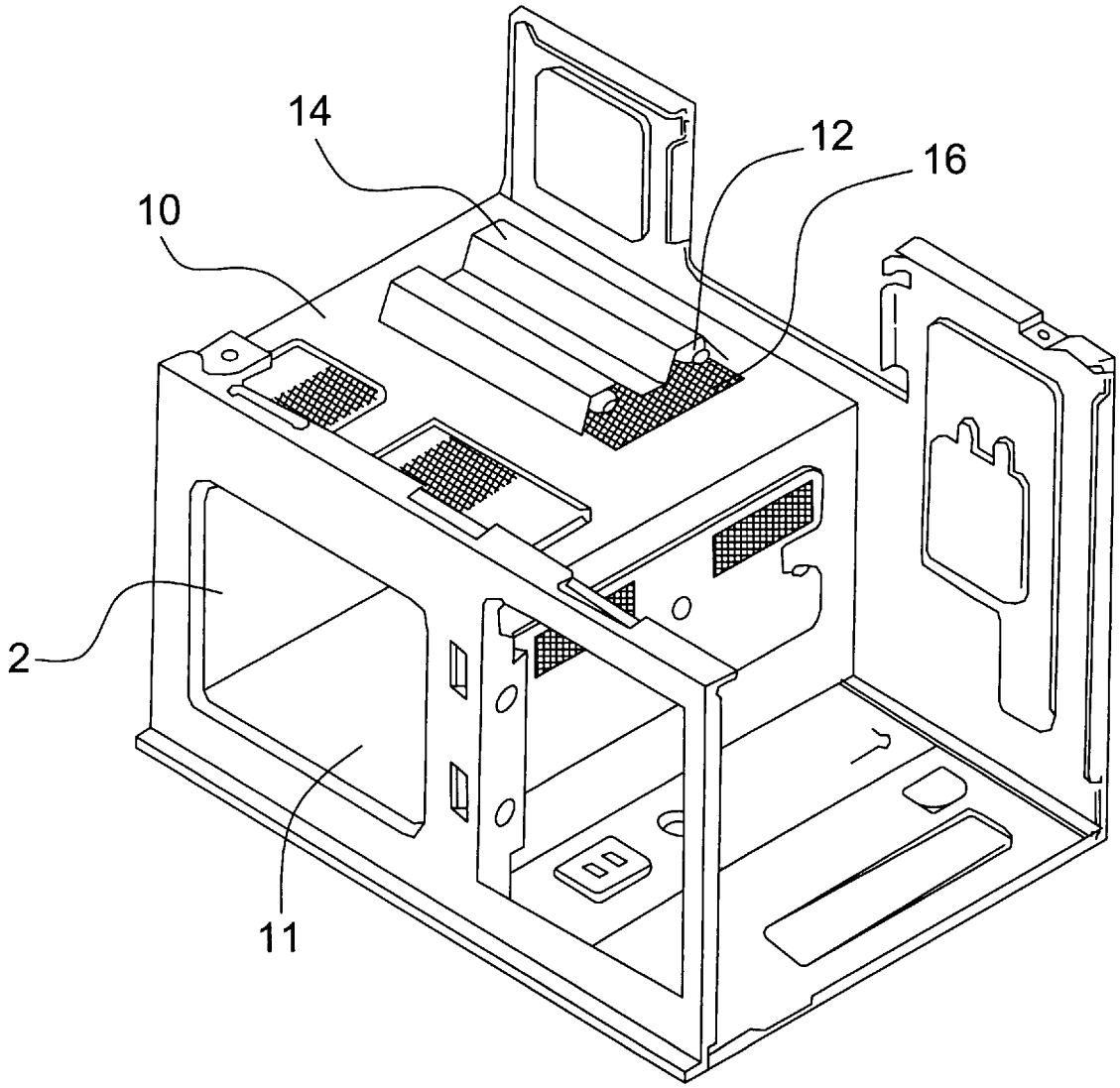
FIG. 1 BACKGROUND ART
FIG. 1 is a perspective view, showing the construction of a conventional microwave oven utilizing a halogen lamp as a heat source.
Figure 2:
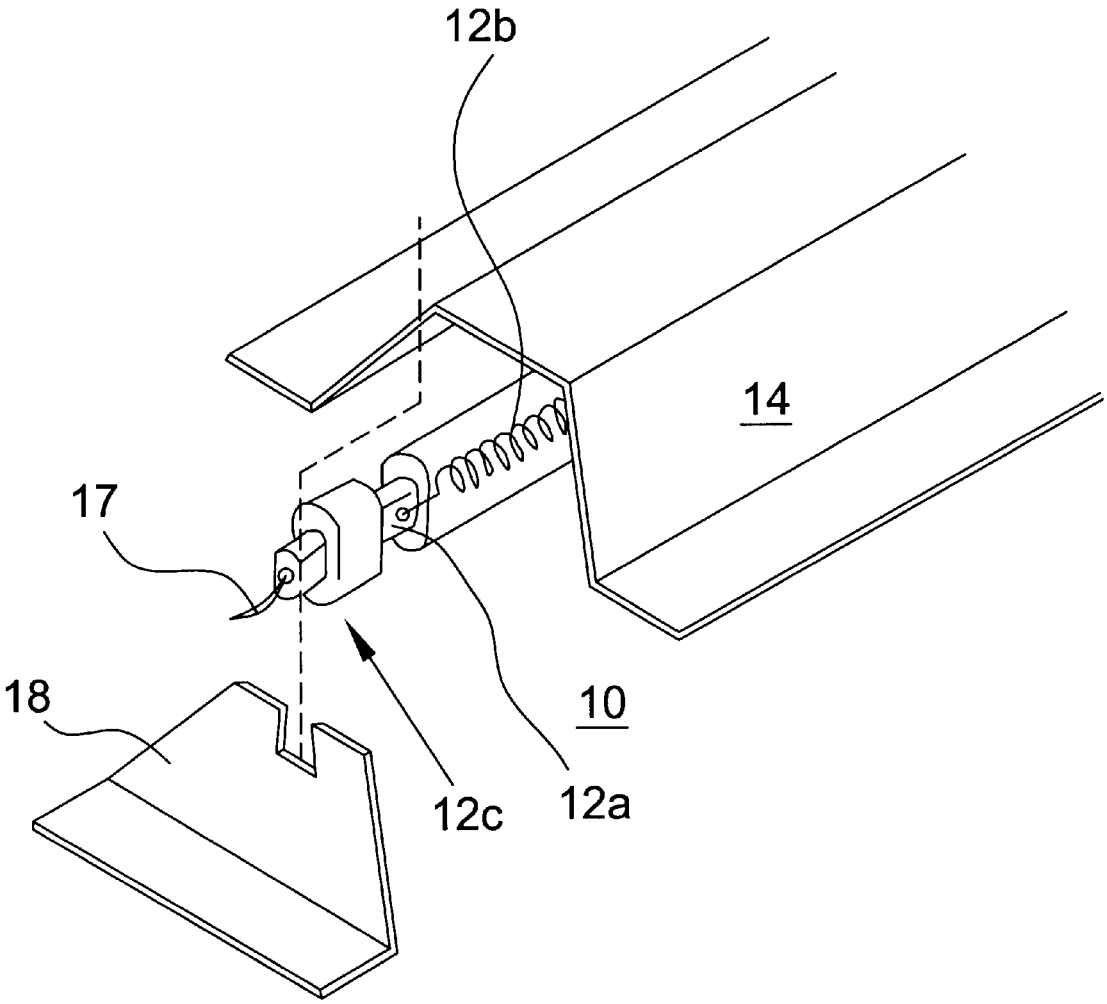
FIG. 2 BACKGROUND ART
FIG. 2 is a perspective view, showing a typical structure for holding the halogen lamp in the microwave oven.
Figure 3:
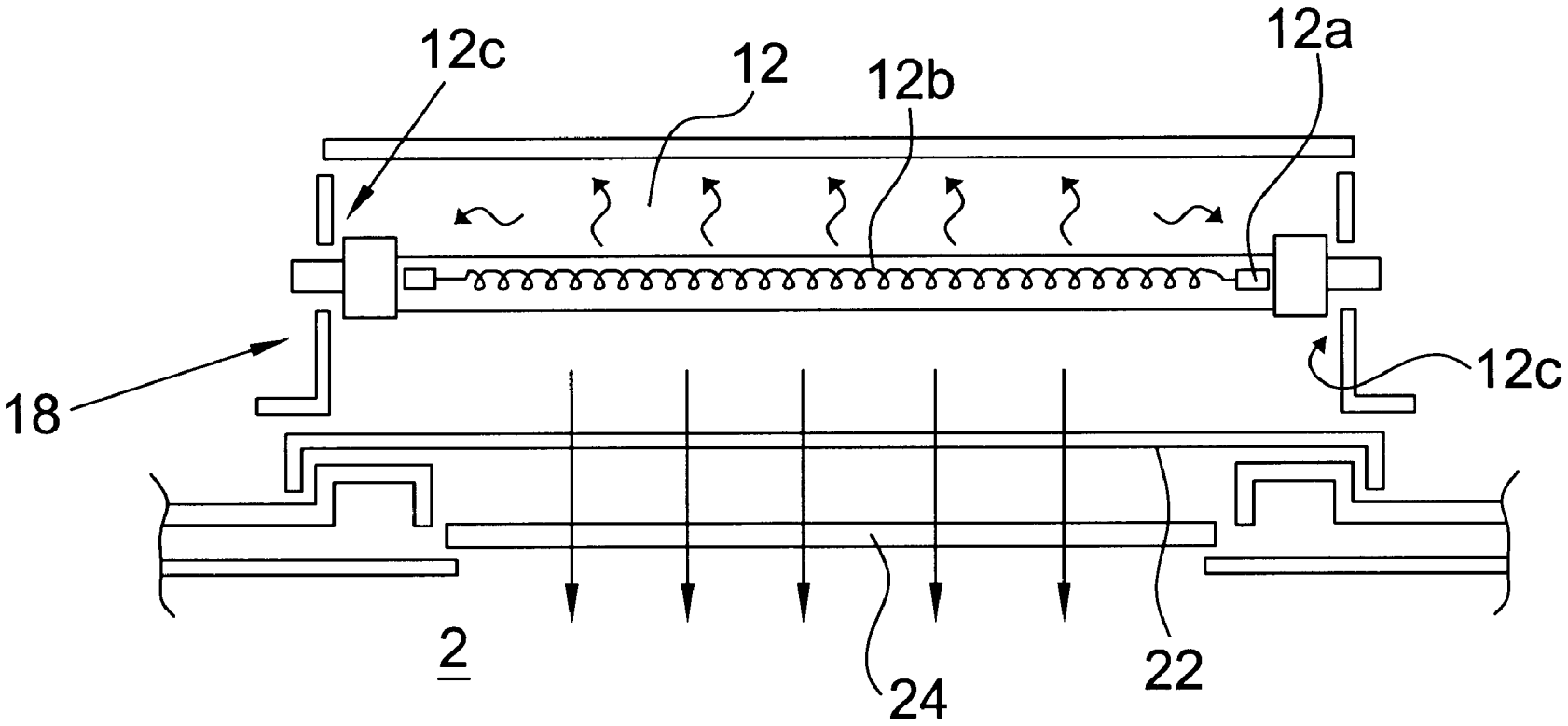
FIG. 3 BACKGROUND ART
FIG. 3 is a front sectional view, showing the typical structure for holding the halogen lamp in the microwave oven.
Figure 4:
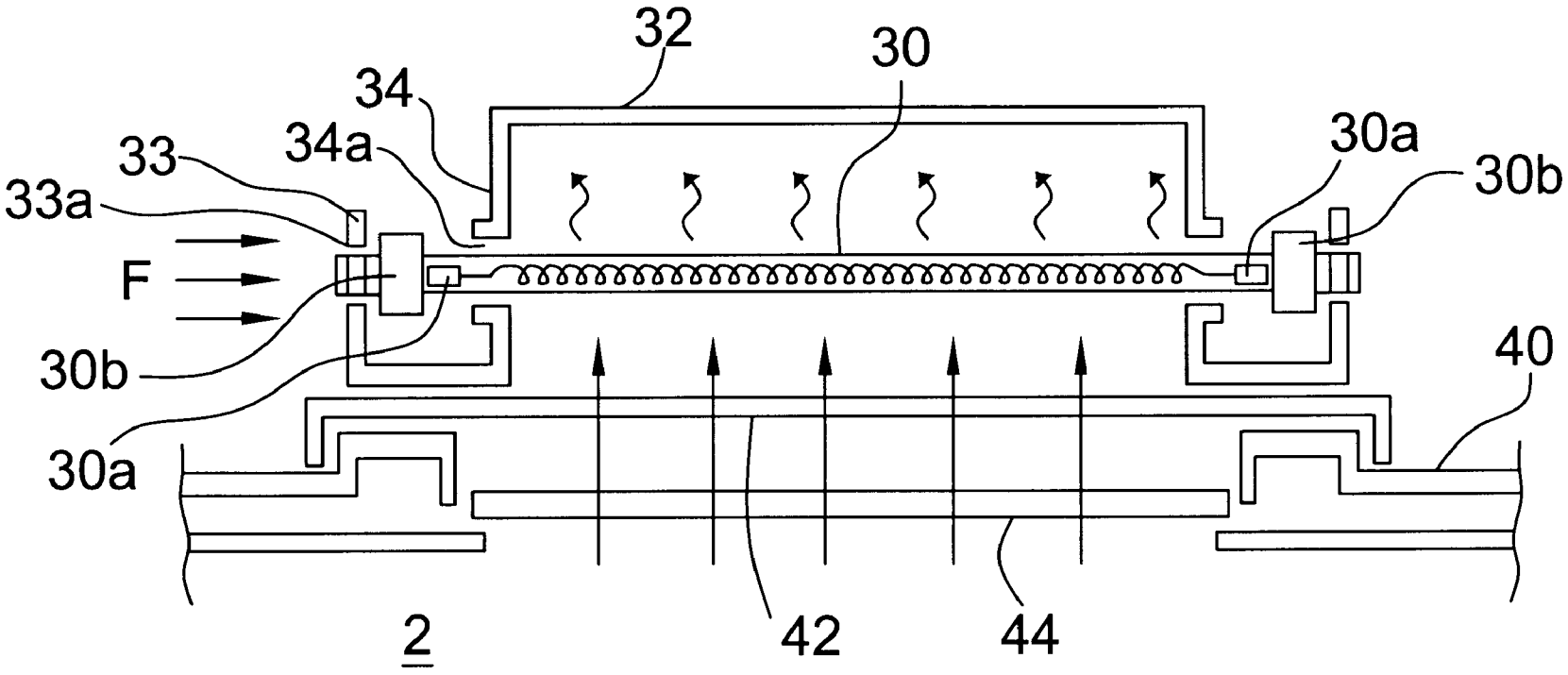
FIG. 4 is a front sectional view, showing a structure for holding the halogen lamp in a microwave oven in accordance with the primary embodiment of the present invention.

FIG. 4 is a front sectional view, showing a structure for holding the halogen lamp in a microwave oven in accordance with the primary embodiment of this invention. As shown in the drawing, the two sealing parts 30*a* of the halogen lamp 30 are positioned outside the light reflection plate 32. When the two sealing parts 30*a* are positioned outside the reflection plate 32, the sealing parts 30*a* are completely exposed to the cooling air current F, emanating from the cooling fan unit (not shown), thus being effectively cooled by the air current. In the drawing, the reference numeral 42 denotes a mesh member which guides the light wave from the halogen lamp 30 into the cavity 2 and intercepts the microwave from the cavity 2, thus protecting the lamp 42. The reference numeral 44 denotes a rotection filter, which protects the halogen lamp 30 from impurities rising from food in the cavity 2 during a cooking operation.

In the embodiment of FIG. 4, the halogen lamp 30 is held with each end of the lamp 30 passing through the lamp holding hole 34*a* formed on each side member 34 of the reflection plate 32. Therefore, the two sealing parts 30*a* of the lamp 30 are positioned outside the side members 34.

Figure 5:
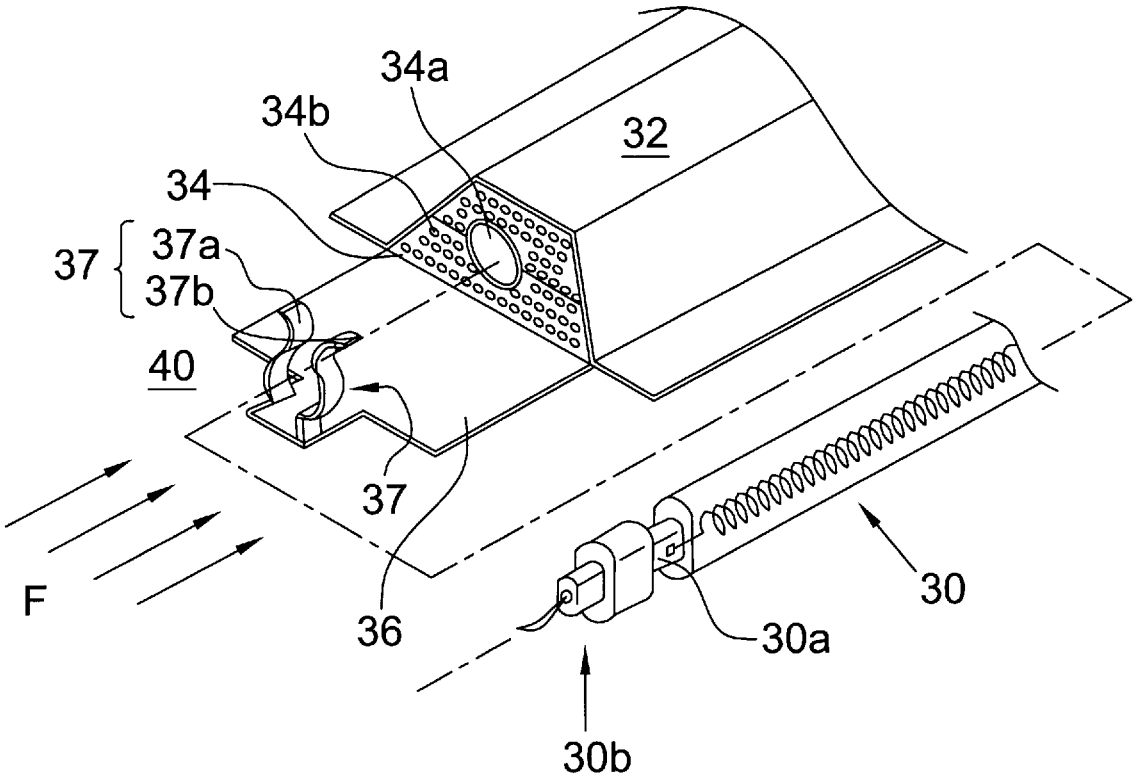
FIG. 5 is a perspective view, showing a structure for holding the halogen lamp in a microwave oven in accordance with the second embodiment of the present invention.

FIG. 5 is a perspective view, showing a structure for holding the halogen lamp in a microwave oven in accordance with the second embodiment of this invention.

As shown in the drawing, the halogen lamp 30 is held by the side members 34 of the reflection plate 32 with the sealing parts 30*a* being positioned outside the side members 34. In a detailed description, the lamp 30 is held by an elastic clamp 37 at each electric insulator part 30*b* thereof. The above clamp 37 comprises two elastic arms 37*a* and 37*b*, which are oppositely positioned to form a fitting mouth at the top end of the clamp 37. The clamp 37 is fixed to the top wall of the cavity 2 at its bottom end. In the embodiment, the bottom of the clamp 37 integrally extends from each side member 34 outwardly. Of course, it should be understood that the clamp 37 may be separately produced prior to being fixedly mounted to a desired position of the top wall of the cavity 2 without affecting the functioning of this invention.

In the embodiment of FIG. 5, the halogen lamp 30 is elastically held on the two clamps 37 by fitting the two insulator parts 30*b* into the mouth of the clamps 37. Of course, it should be understood that another part of the lamp 30 in place of the insulator parts 30*b* may be held on the clamps 37 without affecting the functioning of this invention. That is, the halogen lamp 30 may be held on the clamps 37 at the insulator parts 30*b* or at the sealing parts 30*a* without affecting the functioning of this invention if the sealing parts 30*a* are positioned outside the reflection plate 32. When the halogen lamp 30 is held on the clamps 37 at the sealing parts 30*a* with the parts 30*a* being positioned outside the reflection plate 32, it is preferable to position the light radiating body of the lamp 30 within the reflection plate 32. When the light radiating body of the lamp 30 is exceedingly exposed to the outside of the lamp holding holes 34*a* of the side members 34, the energy loss of the light waves, emanating from the lamp 30, exceeds an acceptable level. Therefore, it is necessary to position the light radiating body of the lamp 30 within the reflection plate 32.

As described above, each side member 34 of the reflection plate 32 is provided with a lamp holding hole 34*a* at the center thereof. A plurality of air passing holes 34*b* are formed on each side member 34 at a position around the lamp holding hole 34*a*, thus allowing the cooling air current to be guided into the interior of the reflection plate 32. In such a case, it is necessary for each air-passing hole 34*b* to prevent a leakage of microwaves from the cavity 2 through the holes 34*b*. Therefore, the diameter of each air passing hole 34*b* has to be designed while considering the relation between the diameter of each hole 34*b* and the wavelength of the microwaves.

The halogen lamp 30 is cooled as follows.

When the halogen lamp 30 is turned on and generates light waves, the cooling fan unit (not shown) is turned on and generates a cooling air current F. The flowing direction of the current F is shown by the arrows in FIGS. 4 and 5. The cooling air current F is primarily brought into contact with the sealing parts 30*a* positioned outside the reflection plate 32, thus cooling the sealing parts 30*a*. The cooling air current F, thereafter, flows over the top wall and the sidewall of the reflection plate 32, thus cooling the plate 32. At the same time, the cooling air current F passes through the air passing holes 34*b* of the side members 34, thus being introduced into the reflection plate 32. Within the reflection plate 32, the cooling air current F cools the surface of the halogen lamp 30 while passing along the lamp 30 prior to being discharged from the plate 32 into the atmosphere.

As described above, the present invention provides a cooling device for a halogen lamp 30 in microwave ovens. In the cooling device of this invention, the sealing parts 30*a* of the halogen lamp 30 are positioned outside the reflection plate 32. Therefore, the heated sealing parts 30*a* are effectively and easily cooled to a desired temperature by the cooling air current.

That is, since the cooling device of this invention is designed in that the sealing parts of the halogen lamp are positioned outside the reflection plate, the sealing parts are directly cooled by the cooling air current. This device thus more effectively and easily cools the sealing parts which are subject to being overheated during a cooking operation of a microwave oven.

A plurality of air passing holes are formed on each side member of the reflection plate so as to introduce the cooling air current into the interior of the reflection plate. Therefore, this device effectively cools the external surface of the halogen lamp.

In a brief description, the cooling device of this invention effectively cools the sealing parts of a halogen lamp in addition to said lamp in a microwave oven. Therefore, the device allows the halogen lamp to normally perform its designed operational function for a lengthy period of time, thereby improving the operational reliability and market competitiveness of the microwave ovens.

Although the preferred embodiments of the present invention have been disclosed for illustrative purposes, those skilled in the art will appreciate that various modifications, additions and substitutions are possible, without departing from the scope and spirit of the invention as disclosed in the accompanying drawings.

What is claimed is:

1. A light radiating assembly for microwave ovens, comprising:

a light radiating lamp configured to be installed on a top wall of a cavity of a microwave oven, said lamp being operated by electric power applied thereto through at least one of two sealing parts provided at each end thereof, said lamp being configured to radiate heating light waves, having a predetermined wavelength, into said cavity;

a light reflection plate surrounding the light radiating lamp while forming a lamp chamber on the top wall of the cavity, the reflection plate being configured to reflect light waves emanating from the lamp into the cavity, and wherein the reflection plate is configured such that the sealing parts of the lamp are positioned outside the lamp chamber;

side members at ends of the reflection plate, wherein the side members are configured to allow the ends of the lamp to pass therethrough, wherein the side members close off the ends of the reflection plate to form the lamp chamber, and wherein air holes are formed through the side members to allow cooling air to pass therethrough; and cooling means for generating a cooling air current and guiding the cooling air current to the sealing parts positioned outside the lamp chamber.

2. The light radiating assembly according to claim 1, wherein the ends of the lamp positioned outside the lamp chamber are held by support means for supporting the lamp.

3. The light radiating assembly according to claim 2, wherein said support means comprises elastic clamps located at either side of the lamp chamber, wherein each elastic clamp is configured to removably hold an end of the lamp, and wherein each clamp has a fitting mouth at its top end.

4. The light radiating assembly according to claim 3, wherein each clamp is configured to hold an electric insulator part of said lamp, each insulator part being provided at an end of the lamp at a position outside a corresponding sealing part.

5. A light radiating assembly for a microwave oven, comprising:

a lamp configured to emit heating light waves, wherein the lamp includes a sealing portion at at least one end thereof; and a lamp holding assembly configured to be attached to an external wall of a cavity of a microwave oven, and to hold the lamp, the lamp holding assembly comprising:

a reflector plate configured to reflecting light waves emitted by the lamp into the chamber of the microwave oven; and end plates that close off ends of the reflector plate to form a reflection chamber, wherein the end plates have a plurality of air holes for allowing cooling air to pass therethrough, wherein the end plates each have a lamp aperture for allowing an end of the lamp to pass therethrough, and wherein the lamp is mounted in the lamp holding assembly such that the at least one sealing portion of the lamp is located outside the reflection chamber.

6. The light radiating assembly of claim 5, wherein the lamp holding assembly also includes clamps configured to hold ends of the lamp, and wherein the clamps are located outside the reflection chamber.

7. The light radiating assembly of claim 6, wherein each clamp includes two opposed elastic arms that are configured to releasably hold an end of the lamp.

8. The light radiating assembly of claim 6, wherein the lamp includes insulator parts that are located at ends of the lamp, and wherein the clamps are configured to releasably hold the insulator parts of the lamp.

* * * * *